US006224283B1

(12) United States Patent
Hay

(10) Patent No.: US 6,224,283 B1
(45) **Date of Patent: *May 1, 2001**

(54) HAND-HELD CLEANING DEVICE

(75) Inventor: Donald Hay, Hong Kong (HK)

(73) Assignee: Hayco Manufacturing Ltd., Wanchai (HK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/438,706

(22) Filed: Nov. 11, 1999

(51) Int. Cl.[7] ..... A46B 11/00; A46B 5/02

(52) U.S. Cl. ..... 401/145; 222/213; 401/6; 401/146; 401/184; 401/186; 401/192; 401/269; 401/275; 401/279; 401/286

(58) Field of Search ..... 401/6, 145, 146, 401/184, 186, 192, 269, 275, 278–280, 286, 152, 156, 206, 219, 263, 270; 222/209, 213, 632

(56) References Cited

U.S. PATENT DOCUMENTS

| | | | | |
|---|---|---|---|---|
| 307,877 | * | 11/1884 | Stevens | 401/184 |
| 371,899 | * | 10/1887 | Osborne | 401/278 X |
| 1,865,850 | * | 7/1932 | Garvey | 401/184 |
| 1,901,822 | * | 3/1933 | Reisinger | 401/184 |
| 2,496,181 | * | 1/1950 | Stange | 401/279 X |

* cited by examiner

*Primary Examiner*—Henry J. Recla
*Assistant Examiner*—Kathleen J. Prunner
(74) *Attorney, Agent, or Firm*—Fish & Neave

(57) ABSTRACT

A fluid-containing brush (10) has a housing (11) with a generally cylindrical side wall (12) closed at one end by a base (20) carrying brush bristles (25) and at the other by a removable cap (50). The housing (11) defines a fluid reservoir and the base (20) has a central bore (21) therein closed by a valve member (32) for dispensing liquid to the brush bristles (25). A valve stem (31) extends up to an actuator button (58) formed on the cap (50). The button (58) is made of elastomeric material and is used to actuate the valve to dispense cleaning fluid. A sealing ring (64) is provided between the cap (50) and housing (11) to ensure a fluid tight connection between the cap (50) and the side wall (12).

11 Claims, 4 Drawing Sheets

HAND-HELD CLEANING DEVICE

The present invention relates to hand-held cleaning devices and, in particular, to such devices which carry and dispense cleaning fluid.

Prior soap-dispensing cleaning devices are known which include a housing defining a soap-containing reservoir, a bottom wall of the housing carrying a cleaning medium, such as a sponge, brush or the like, the reservoir being closed by a cap. A valve assembly dispenses fluid from the reservoir to the cleaning medium. One such device is disclosed in EP-A-0198 389. Here, there is provided at the base of the housing a valve assembly having a lower opening defining a valve seat, and a thin valve stem protruding downwardly through the opening. As the user presses the bottom of the device against an object to be cleaned the valve stem is forced upwardly against the action of a resilient support, allowing the soap to drain from the reservoir.

One problem with this structure is that the device is prone to leakage both at the position of the valve and at the screw cap.

The invention seeks to provide an improved fluid-containing cleaning device which avoids the disadvantages of prior such devices while affording additional structural and operating advantages.

According to the present invention there is provided a hand-held cleaning device comprising a housing constituting a reservoir for cleaning fluid and carrying cleaning means for contacting an object or surface to be cleaned, an aperture through which cleaning fluid may pass closed by valve means which are operable by a user, and a removable cap closing the housing, wherein a portion of the cap is formed of resilient material deformable by a user, a part of the valve means extending to said portion of resilient material whereby a user can operate the valve means on deformation of the said portion, and wherein there is provided a sealing ring of resilient material between the cap and housing.

The arrangement of user-actuable valve means operable by means on the cap, and the cap seal both serve to ensure easy and leak-free dispensing of the cleaning fluid.

Preferably, the valve means comprises a valve stem which extends through the housing to the cap having an end portion which lies adjacent an inner surface of the portion of resilient material. The valve means includes a valve member arranged on an end of the valve stem which sits in a valve seat, the valve stem being biased by resilient means towards the cap so that the valve member engages in the valve seat.

The resilient portion preferably comprises a web of resilient material covering an opening in the cap. This web may further comprise a cylindrical skirt portion depending from the web in which an end portion of the valve stem is received. The web may also have a groove at a periphery of the web of the resilient material adjacent the junction with the cap.

The sealing ring and resilient web are preferably both formed of an elastomer and preferably the same elastomer moulded onto the cap in a single moulding step. This single-step moulding is particularly advantageous in terms of cost and efficiency of manufacture.

In the preferred embodiment the cap has a depending generally cylindrical skirt and an upper wall, the sealing ring being arranged on the inside of the cap adjacent the junction between the skirt and the upper wall at a position at which in use it tightly abuts an upper edge of the housing when the cap is fitted thereto.

An embodiment of the present invention is now described, by way of example only, with reference to the following drawings in which.

Figure 1:
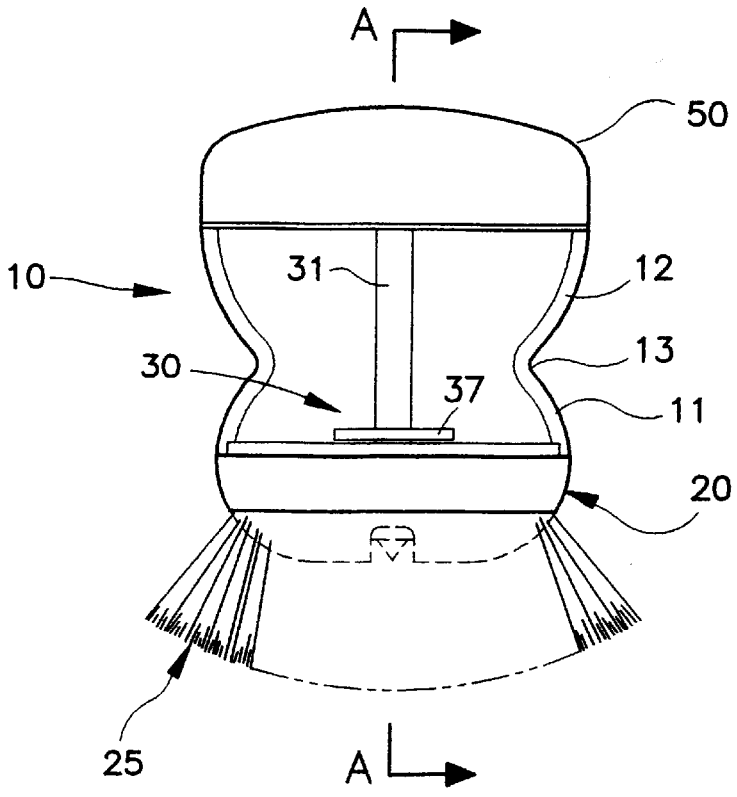
FIG. 1 is a front elevational view of a cleaning device in accordance with an embodiment of the present invention.
Figure 2:
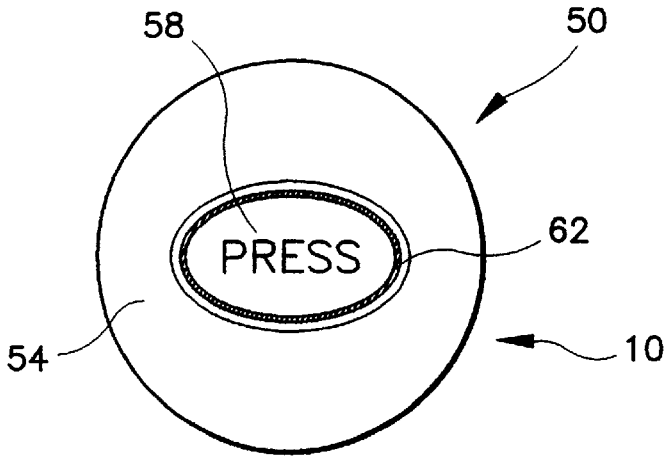
FIG. 2 is a top plan view of the cleaning device of FIG. 1.
Figure 3:
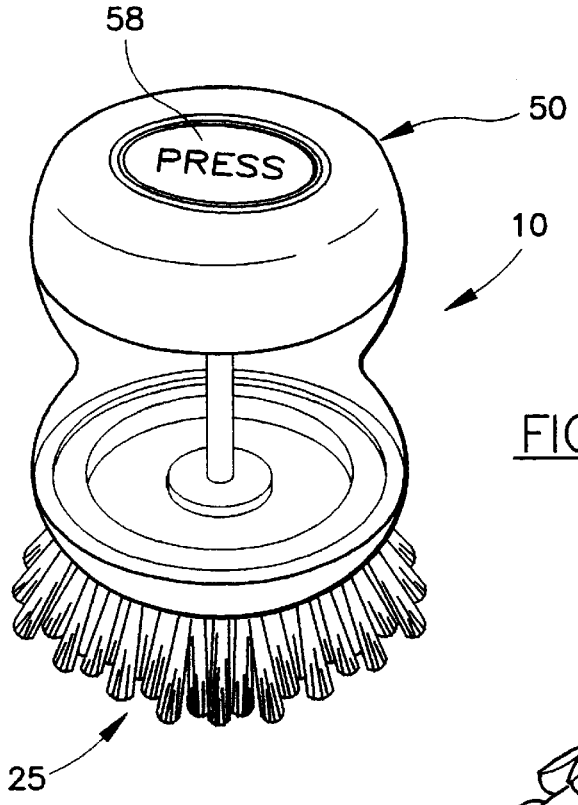
FIG. 3 is a front perspective view of the cleaning device of FIG. 1.

Referring to the drawings, there is illustrated a fluid-containing cleaning device, generally designated by the numeral 10, constructed in accordance with an embodiment of the present invention. The cleaning device 10 has a housing 11 which includes a generally cylindrical side wall 12, preferably formed of a transparent or translucent material, such as a suitable plastics material. The side wall 12 has a radially inwardly projecting circumferential depression 13 formed therein intermediate the upper and lower ends thereof, which can serve as a finger grip to facilitate grasping of the device by a user. The side wall 12 is provided at its upper end with a circumferential lip 14 along the upper end edge. Four short rectangular lugs 16 project radially outwardly from the near upper end of the lip 14 at equiangularly spaced locations. An annular groove 17 is formed in the lower end of the side wall 12 and is adapted to receive therein an annular flange 19 projecting axially from the annular end face 18 of a base wall 20, which may be formed of a suitable plastics material. The base wall 20 is fixedly secured to the side wall 12 for closing the lower end thereof by any suitable means, such as by adhesive or ultrasonic welding.

The base wall 20 has an axial bore 21 formed therethrough (FIG. 7) which is provided with an enlarged-diameter counterbore 22 at its inner end and, at its outer end, with a counterbore 23 having a frustoconical inner end wall 24 defining a valve seat. Fixedly secured to the outer surface of the base wall 20 is a suitable scrubbing medium 25 which, in the illustrated embodiment, comprises a plurality of brush bristles, which may be fixed in sockets 26 in the base wall 20 by any suitable means. Although bristles are illustrated, these could equally be replaced by an abrasive pad, scouring pad, wire wool pad, sponge or other similar cleaning media. It will be appreciated that the axial bore 21 provides communication between the interior of the housing 11 and the cleaning medium 25.

Figure 5:
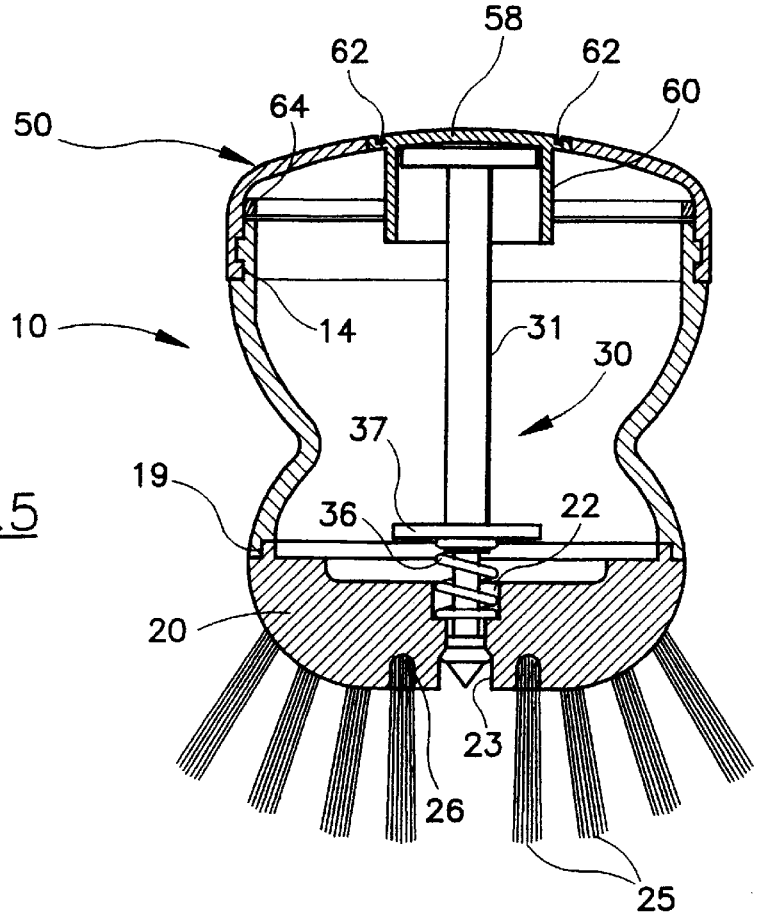
FIG. 5 is an enlarged view in vertical section taken along the line A—A in FIG. 1.
Figure 6:
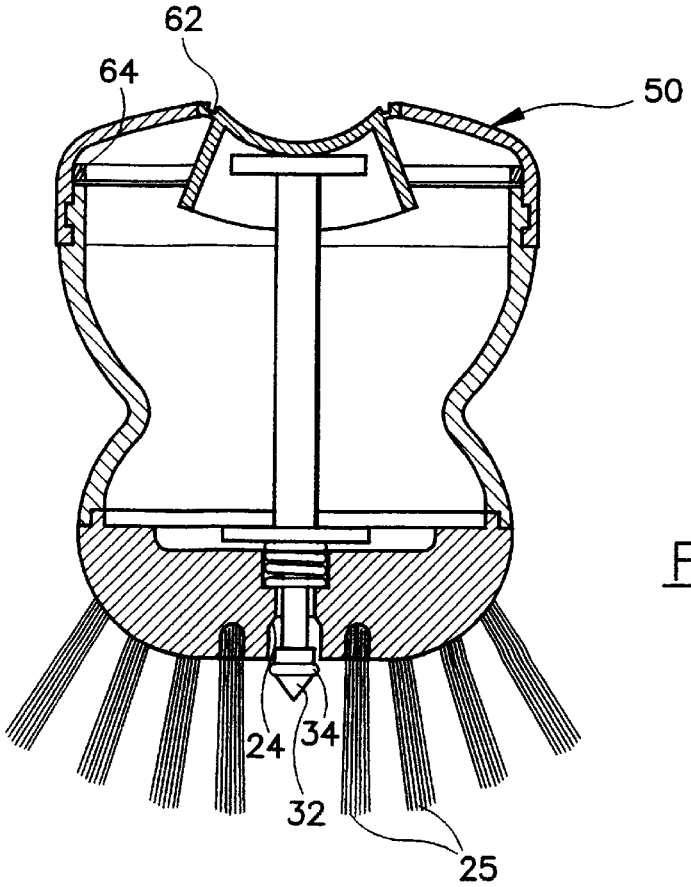
FIG. 6 is a view similar to FIG. 5, illustrating the valve assembly in its open condition.
Figure 7:
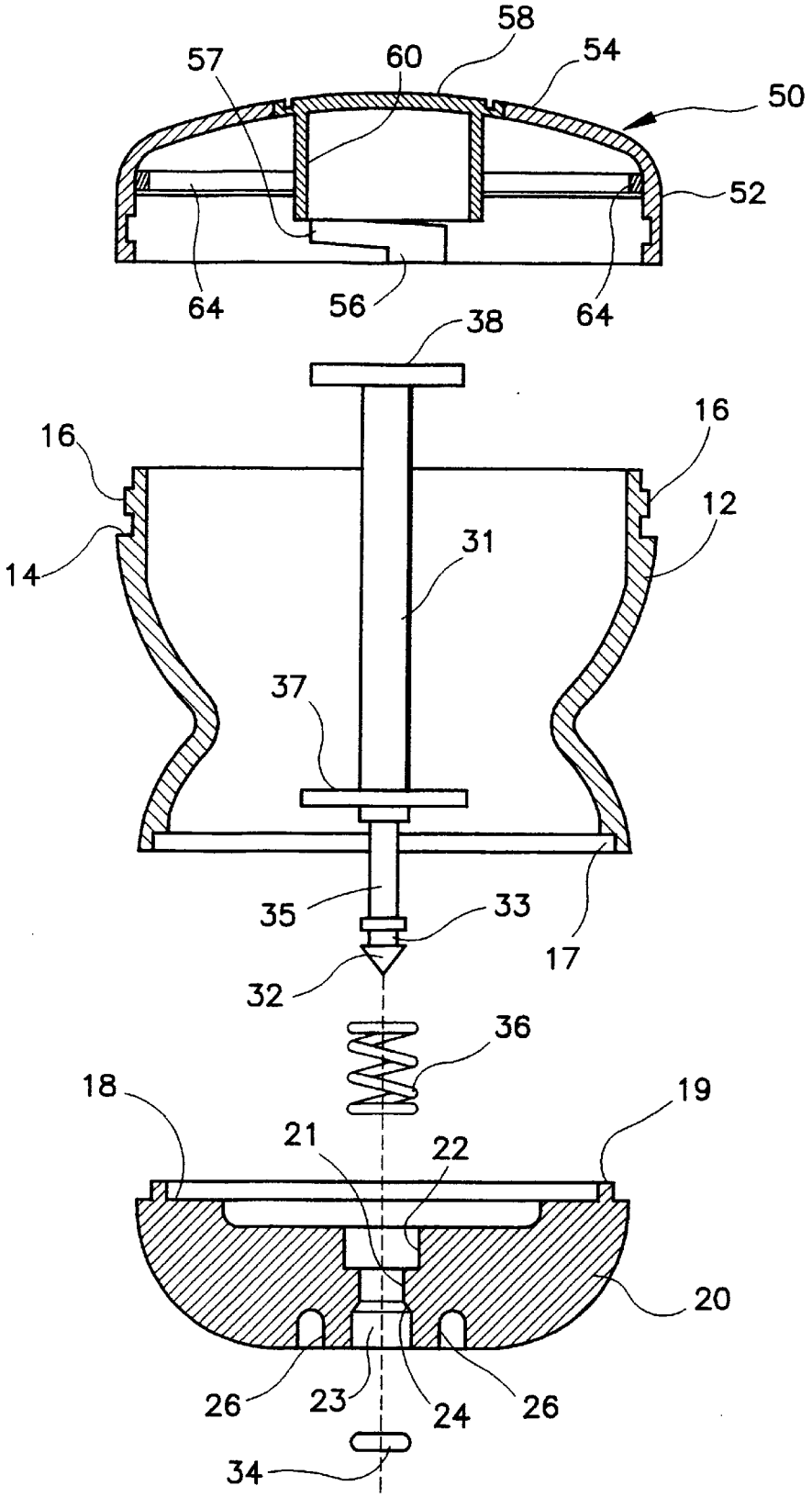
FIG. 7 is an enlarged, exploded, sectional view of the device of FIG. 1.

Referring in particular to FIGS. 5–7, the axial bore 21 is closeable by a valve assembly 30 which includes an elongated valve stem 31 extending axially through the housing 11 and through the axial bore 21, being provided at its distal end with a conical head 32. A valve member in the form of a flexible and resilient O-ring seal 34 is seated in a circumferential groove 33 in the stem 31 immediately above the head 32. The stem 31 preferably has a reduced-diameter neck portion 35 adjacent to the head 32, which is surrounded by a helical compression spring 36, one end of which is seated in the bore 22 and the other end of which is seated against a radially outwardly extending annular flange 37 on the stem 31. The upper end of the stem 31 is formed with an enlarged head 38.

The upper end of the housing 11 is closed by a removable cap 50 which has a generally cylindrical skirt portion 52 and an upper slightly upwardly-doming top portion 54. Removal of the cap 50 allows refilling of the device with cleaning fluid. The cap is preferably formed of a rigid plastics material. The skirt portion of the cap is provided on its inner surface with four equiangularly spaced generally L-shaped recesses 56 having slightly inclined surfaces 57 which co-operate with the lugs 16 on the housing 11 to hold the cap 50 on the housing 11. The cap is fitted by a push and twist action whereby the lugs 16 on the housing 11 engage in the recesses, the cap 50 being urged more tightly onto the housing 11 as it is rotated and the slightly inclined surfaces 57 move over the lugs 16 It will be appreciated that the cap could alternatively be removably fitted on the housing by other means such as a simple screw fit.

The centre of the cap 50 is provided with an opening which is closed by a thin web formed of a resilient material such as an elastomer which portion constitutes an actuator button 58. The button 58 is of generally oval shape when viewed from above, and is provided with a depending cylindrical skirt 60 into which the enlarged head 38 of the valve stem extends in the assembled device so that in the normal condition this is adjacent the inner surface of the button, as shown in FIG. 5. The button 58 is formed with a groove 62 adjacent the periphery thereof. This groove 62 constitutes a portion of reduced thickness which facilities depression of the button.

Figure 4:
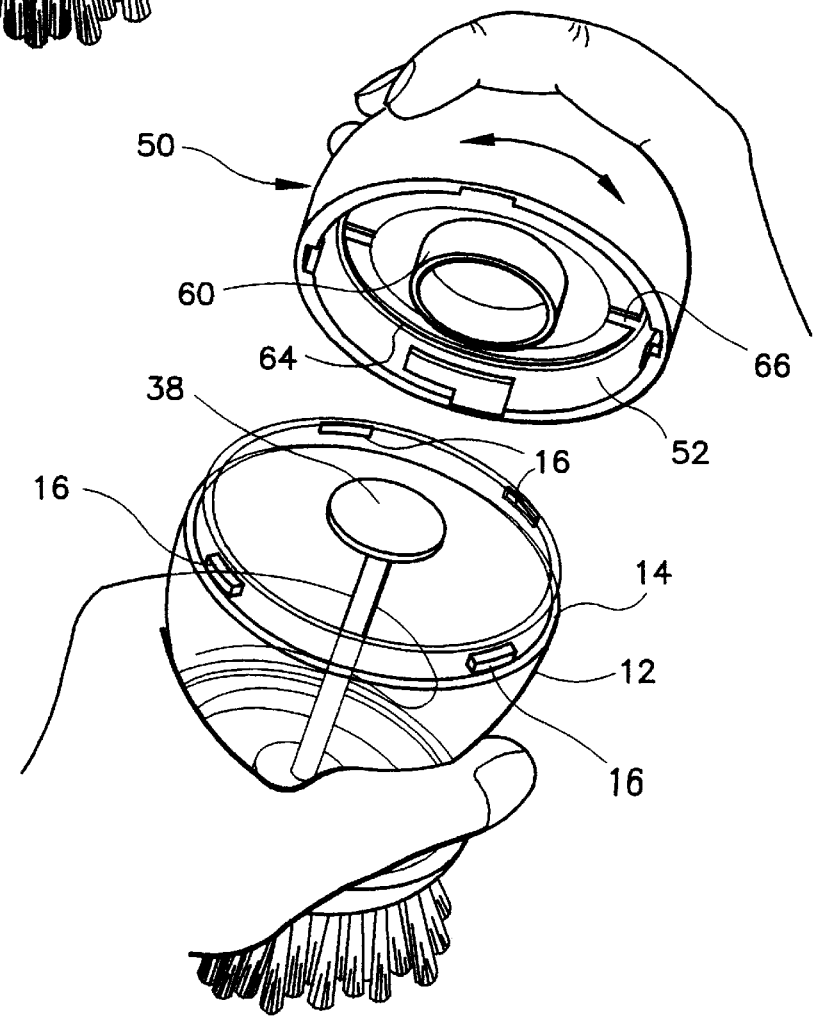
FIG. 4 is a perspective view illustrating opening of the cap of the cleaning device of FIG. 1.

Located in the cap 50 at an inner corner between the skirt 52 and upper doming portion 54 there is provided a circular ring 64 of resilient material which is preferably also formed of an elastomer and in particular formed of the same material as the button 58. When the cap 50 is fitted on the housing the uppermost edge of the lip 14 abuts this ring 64 thereby ensuring a reliable fluid-tight connection is achieved. The cap 50 is formed as follows. The main part of the cap is preferably formed of a rigid plastics material which is formed in a conventional mould. The cap is then placed in a further mould defining the shape of the sealing ring 64 and the button 58 and the elastomer moulded thereon in a single moulding step. The single moulding step greatly simplifies the manufacture of the cap. Depending on the precise shape of the mould used to mould the elastomer of the button 58 and sealing ring 64 there may be a residual portion or portions of elastomer extending between the button 58 and ring 64 as indicated at 66 in FIG. 4.

In use, it will be appreciated that the spring 36 resiliently biases the valve assembly 30 upwardly to a normal closed condition, illustrated in FIG. 5, wherein the O-ring seal 34 seats against the wall 24 of the counterbore 23 and cooperates with the stem 31 to seal the opening defined by the axial bore 21. When the actuator button 58 is depressed by the user the stem 31 is also depressed, and the O-ring seal 34 unseats, as illustrated in FIG. 6, permitting liquid soap or other fluid to flow through the axial bore 21 to the scrubbing medium 25, the outward movement of the stem 31 being limited by engagement of the flange 37 with the inner surface of the housing base wall 20. It will be observed that the skirt 60 of the button 58 also deforms as the button is depressed. When pressure is relaxed from the button 58 the valve stem 31 is upwardly returned to the normal closed condition with the seal 34 closing the valve seat.

What is claimed is:

1. A hand-held cleaning device comprising a housing constituting a reservoir for cleaning fluid and carrying cleaning means for contacting an object or surface to be cleaned, an aperture through which cleaning fluid may pass closed by valve means which are operable by a user, and a removable cap closing the housing wherein a portion of the cap in formed of resilient material deformable by a user, a part of the valve means extending to said portion of resilient material whereby a user can operate the valve means on deformation or the said portion, and wherein there is provided a sealing ring of resilient material between the cap and housing.

2. A cleaning device according to claim 1 wherein the valve means comprises a valve stem which extends through the housing to the cap having an end portion which lies adjacent an inner surface of the portion of resilient material.

3. A cleaning device according to claim 2 wherein the valve means includes a valve member arranged on an end of the valve stem which sits in a valve seat, the valve stem being biased by resilient means towards the cap so that the valve member engages the valve seat.

4. A cleaning device according to any of claims 2 or 3 wherein the resilient portion comprises a web of resilient material covering an opening in the cap.

5. A cleaning device according to claim 4 wherein the resilient portion further comprises a cylindrical skirt portion depending from the web in which an end portion of the valve stem is received.

6. A cleaning device according to claim 4 wherein there is formed a groove in the web at a periphery of the web of the resilient material adjacent the junction with the cap.

7. A cleaning device according to any of claims 1–3 wherein the sealing ring and the said portion of resilient material are both formed of an elastomer.

8. A cleaning device according to any of claims 1–3 in which the sealing ring and the said portion of resilient material are formed of the same material which has been moulded onto the cap in a single moulding step.

9. A cleaning device according to any of claims 1–3 wherein the cap has a depending generally cylindrical skirt and an upper wall, the sealing ring being arranged on the inside of the cap adjacent the junction between the skirt and the upper wall at a position at which in use it tightly abuts an upper edge of the housing when the cap is fitted thereto.

10. A method of manufacturing the cleaning device of any of claims 1–3, the method comprising the step of moulding the portion of resilient material and the sealing ring onto the cap in a single moulding step.

11. A cleaning device according to claim 1 wherein the sealing ring of resilient material is secured to the cap by moulding onto the cap.

* * * * *

UNITED STATES PATENT AND TRADEMARK OFFICE

CERTIFICATE OF CORRECTION

PATENT NO. : 6,224,283 B1
DATED : May 1, 2001
INVENTOR(S) : Donald Hay

It is certified that error appears in the above-identified patent and that said Letters Patent is hereby corrected as shown below:

Title page,
Item [56], References Cited Under U.S. PATENT DOCUMENTS, please insert the following U.S. PATENT DOCUMENTS per the Information Disclosure Statement filed 1/30/01:

| | | |
|---|---|---|
| -- 3,146,484 | 9/1964 | L.E. Lussier et al. |
| 4,826,340 | 5/1989 | Rothweiler et al. |
| 4,955,746 | 9/1990 | Craigmile |
| 5,114,255 | 5/1992 | Villarreal --. |

Column 3,
Line 11, please change "16" to -- 16. --.

Column 4,
Line 10, please change "in" to -- is --.
Line 13, please change "or" to -- of --.

Signed and Sealed this

Twentieth Day of November, 2001

*Attest:*

Nicholas P. Godici

NICHOLAS P. GODICI
*Acting Director of the United States Patent and Trademark Office*

*Attesting Officer*